US008546690B2

(12) United States Patent
Masakazu et al.

(10) Patent No.: US 8,546,690 B2
(45) Date of Patent: Oct. 1, 2013

(54) MULTIMEDIA CABLE

(75) Inventors: Yoshida Masakazu, Kanagawa-ken (JP); Terence Chan Yuk Kwan, Hong Kong (HK)

(73) Assignee: Belden Inc., St. Louis, MO (US)

( * ) Notice: Subject to any disclaimer, the term of this patent is extended or adjusted under 35 U.S.C. 154(b) by 361 days.

(21) Appl. No.: 12/985,172

(22) Filed: Jan. 5, 2011

(65) Prior Publication Data

US 2011/0162866 A1 Jul. 7, 2011

Related U.S. Application Data

(60) Provisional application No. 61/292,376, filed on Jan. 5, 2010.

(51) Int. Cl.
*H01B 7/00* (2006.01)
*H01B 11/00* (2006.01)

(52) U.S. Cl.
USPC ..... 174/103; 174/113 A; 174/130; 174/131 B

(58) Field of Classification Search
USPC ..... 174/113 A, 130, 131 B, 103
See application file for complete search history.

(56) References Cited

U.S. PATENT DOCUMENTS 3,291,891 A * 12/1966 Sharp ..... 174/36
4,096,346 A * 6/1978 Stine et al. ..... 174/36
4,125,741 A * 11/1978 Wahl et al. ..... 174/120 SC
4,980,517 A * 12/1990 Cardas ..... 174/129 R
5,510,578 A * 4/1996 Dunlavy ..... 174/128.1
6,195,487 B1 2/2001 Anderson et al.
6,452,107 B1 * 9/2002 Kebabjian ..... 174/113 R
6,674,010 B2 * 1/2004 Inui ..... 174/113 R
7,750,244 B1 * 7/2010 Melding ..... 174/113 R
8,008,577 B2 * 8/2011 Lima et al. ..... 174/103
8,076,580 B2 * 12/2011 Kolasa et al. ..... 174/105 R
2003/0019657 A1 1/2003 Seigerschmidt
2007/0280610 A1 12/2007 Mallya et al.
2008/0047732 A1 * 2/2008 Park et al. ..... 174/107
2008/0247716 A1 10/2008 Thomas et al.
2008/0314613 A1 * 12/2008 Huang et al. ..... 174/107
2009/0260849 A1 * 10/2009 Cardas ..... 174/114 R
2010/0051318 A1 * 3/2010 Wang ..... 174/113 R
2010/0084157 A1 * 4/2010 Wang ..... 174/107
2010/0258333 A1 * 10/2010 Horan et al. ..... 174/78
2011/0162866 A1 * 7/2011 Masakazu et al. ..... 174/103

OTHER PUBLICATIONS

International Search Report from International Application PCT/US2011/020251 dated Aug. 12, 2011.

* cited by examiner

*Primary Examiner* — Timothy Thompson
*Assistant Examiner* — Nathan Milakovich
(74) *Attorney, Agent, or Firm* — Lando & Anastasi, LLP

(57) ABSTRACT

A multimedia cable, particularly one designed to carry digital signals in accordance with an HDMI standard, which comprises two or more concentric rings of conductor cores arranged about a central conductor core.

17 Claims, 5 Drawing Sheets

MULTIMEDIA CABLE

CROSS REFERENCE TO RELATED APPLICATION(S)

This application claims the benefit of U.S. Provisional Patent Application 61/292,376 filed Jan. 5, 2010, the entire disclosure of which is herein incorporated by reference.

BACKGROUND OF THE INVENTION

1. Field of the Invention

This disclosure relates to the field of electronic cables. In particular, to high speed cables for the transfer of digital information. Specifically, the cables discussed herein are multimedia cables which are more commonly called High Definition Multimedia Interface (HDMI) cables based upon the transmission standard commonly used across them. Based on their size, embodiments discussed herein could be described as miniature HDMI cables.

2. Description of Related Art

The field of home entertainment is growing exponentially. On the video front, black and white analog signals were state of the art 100 years ago. Now high-definition color is becoming the norm. Further, reliance on broadcast signals has been replaced with digital cable, Blu-Ray™ video sources, and digital recorders. Today's video screens can reproduce vast color palates in incredible resolution. Further, they generally have much larger (and differently proportioned) screens while still taking up less space.

Along with improvements to the video display of a home entertainment system, there have been major changes and improvements to audio reproduction. Audio today can also be stored and transferred digitally in conjunction with associated video or on its own. Further, no longer is there only a single speaker confined to being placed at the screen. Audio is provided in a multitude of channels to immerse the viewer into a program as never before possible.

Along with these improvements in sound and video reproduction, the rise of the Internet and computer storage of data has also created new ways to obtain entertainment. Digital storage and transmission of entertainment programming allows for a user to obtain copies of a particular entertainment program which can be played a near limitless number of times without degradation and that can be freely transferred between different pieces of equipment and watched "on-demand".

With all this new functionality, however, comes the requirement to be able to transfer the data between an increasingly large number of different devices. While 20 years ago a television was a self contained device supplying audio, video, and content, today, the demand for better sources and reproduction has led to the average home theatre comprising a couple of core devices and a multitude of different peripherals. Transferring the data between these different devices has resulted in many entertainment systems having a rat's nest of cables of different standards and quality.

There are a lot of standards, and therefore also a lot of cables, that are used for the transmission of audio and video data. Component Video, S-Video, Fiber Optic, and others are all technologies which have their good and bad points. One of the principle concerns with much of the technology, however, is the proliferation of cables and the need to have a large number of physical cables to connect components. Further, a setup is often only as good as its weakest link.

In order to simplify the cable issue, the High Definition Multimedia Interface (HDMI) standard was previously proposed. This standard provides for a fully digital transmission of audio, video, and data across cables designed to use the standard. These HDMI cables are designed to meet the requirements and therefore provide conductors to carry three audio channels and three video channels (corresponding to the three components of a color signal) and a number of other supporting signals including those that can allow for devices to exchange instructions (consumer electronics channel (CEC)), hot plug detect for determining if components are added or removed, and the Display Data Channel (DDC) for encryption and related device information. Newer standards (HDMI 1.4) also include Ethernet data and audio return channels (HEAC). The standards of HDMI, along with how the cables are terminated at an HDMI jack are publicly available at www.hdmi.org, the entire disclosure of which is herein incorporated by reference.

An HDMI cable will need to include at least eighteen separate conductors to carry all the signals required under the current (version 1.3) HDMI standard. An embodiment of such a cable (900) is shown in FIG. 1. Twelve of the conductors are individually jacketed (forming cable cores indicated by the hollow circles of FIG. 1) and arranged into four twisted pair groups (with an unjacketed ground (represented by the shaded circles) each) (901), (903), (905), and (907) to carry the three channels of audio and video and a clock signal. Each twisted pair group then includes a dedicated jacket (991), (993), (995) and (997). Two conductors (one core and an unjacketed ground) form the power and general ground (911) while 4 remaining cores serve as the special channels. Specifically the DDC (which uses two cores) (921), CEC (923), and hot plug detect (925) along with an unused core (927) reserved for use by a future standard. Which of the specific cores (923), (925) and (927) is used for which purpose can change based on how the manufacturer chooses to connect the cores (923), (925), and (927).

The standard HDMI cable therefore comprises four component twisted-pair cables (each with its own shielding) (901), (903), (905), and (907), a power cable with ground (911), and specialty cores (921), (923), (925) and (927). This entire bundle is then placed inside a MYLAR (polyester film or plastic sheet) tape (952), wire braid shield (954), and insulative jacket (956) to form a representative HDMI cable.

While this arrangement provides for good signal quality and a simplified connection, it does provide some problems. Firstly, the use of twisted pair cables (901), (903), (905) and (907) requires additional space to accommodate the twisting as well as the inclusion of individual shielding (991), (993), (995) and (997) for each of the twisted pairs (901), (903), (905) and (907). This can make the cable (900) more bulky than necessary and can result in it being unsuitable for applications where a small cable may be necessary (for example in internal wiring or in portable devices).

Further the HDMI standard which utilizes parallel transmission can result in crosstalk between twisted pairs (901), (903), (905) and (907). Thus, as speed has to increase, and as cable length increases, wire gauge in the cores generally has to increase or else there can be signal degradation. As the signal is digital, instead of analog, signal degradation can result in parts of the signal being lost which in turn can result in a massively degraded signal quality. As the HDMI standard is real time (as opposed to most standard data transmission such as in Ethernet connections), there are also enormous problems with longer cable runs and reliable HDMI transmission has generally been limited to only a few feet.

In many cases this is acceptable as the distance between components in a home theatre may be well within these distances. For some applications, however, the length limitation can be significant. When particularly small diameter cables are needed (such as with portable devices or connections internal to devices where space is a premium) the traditional HDMI cable may simply be unable to provide reliable performance.

For the above and other reasons known to those of ordinary skill in the art, described herein is a multimedia cable designed for use with HDMI standards (such as, but not limited to, HDMI 1.3 and 1.4) which provides for a coaxial arrangement of internal conductors doing away with the traditional twisted pair construction while still maintaining signal quality.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of the above described and other problems in the art, described herein, among other things, is a multimedia cable, particularly one designed to carry digital signals in accordance with an HDMI standard which comprises two or more concentric rings of conductor cores arranged about a central conductor core.

In an embodiment, the multimedia cable comprises: a central cable core; a first ring formed of a first plurality of cable cores arranged concentrically about the central cable core; and a second ring formed of a second plurality of cable cores arranged about the first concentric ring of cable cores; wherein the central cable core, the first plurality of cable cores, and the second plurality of cable cores comprise a total of at least nineteen cables cores; wherein the first plurality of cable cores are arranged generally parallel to each other; and wherein the second plurality of cable cores are arranged generally parallel to each other.

In an embodiment of the multimedia cable the cable is suitable for carrying signals in accordance with the HDMI standard version 1.3 or 1.4.

In an embodiment of the multimedia cable the at least nineteen cable cores, and possibly exactly nineteen cores, comprises at least fourteen individually shielded cable cores and at least five unshielded cable cores. The first plurality of cable cores may include a single unshielded cable core and the second plurality may include four unshielded cable cores.

In an embodiment of the multimedia cable the at least nineteen cable cores comprises at least twenty-two cable cores which may comprise at least, or exactly, seventeen individually shielded cable cores and at least, or exactly, five unshielded cable cores. Eight of the individually shielded cable cores and one of the unshielded cable cores may form the first plurality and eight of the shielded cable cores and four of the unshielded cable cores may form the second plurality. The second plurality may form a repeating pattern of sets, each set formed from an unshielded cable core and two individually shielded cable cores. The first plurality may comprise at least eight cable cores and the second plurality may comprise at least fifteen cable cores. The first plurality may, in turn, comprise at least seven individually shielded cable cores and the second plurality may, in turn, comprise at least ten individually shielded cable cores.

In an embodiment the multimedia cable further comprises a shield arranged between the first ring and the second ring. It may also further comprise Al-MYLAR (Aluminum and polyester film or plastic sheet) tape arranged between the first ring and the second ring. In an embodiment, the multimedia cable further comprises a shield surrounding the second ring and may also further comprise Al-MYLAR (Aluminum and polyester film or plastic sheet) tape surrounding the second ring and/or an insulative jacket surrounding the shield that is surrounding the second ring.

There is also described herein, in an embodiment, a multimedia cable comprising: a central cable core; a first concentric ring formed from eight individually shielded cable cores and one unshielded cable core arranged about the central cable core; and a first shield surrounding the first concentric ring; a second concentric ring formed from eight individually shielded cable cores and four unshielded cable cores arranged about the first concentric ring; a second shield surrounding the second concentric ring; and an insulative jacket surrounding the second shield; wherein the cable cores forming the first concentric ring are arranged generally parallel to each other; and wherein the cable cores forming the second concentric ring are arranged generally parallel to each other.

DESCRIPTION OF THE PREFERRED EMBODIMENT(S)

The following description illustrates by way of example and not by way of limitation. As discussed above, the HDMI standard provides for various specifications of how many conductors provide what data at what rate and quality. The HDMI standard, in many respects, does not dictate physical design of cable, but instead dictates how the cable terminates and how the cable performs. Thus, while the standard HDMI terminology will generally be used throughout this application, one should recognize that where traditional HDMI has used a traditional twisted pair group, the current cable, while still using a group comprising a pair of conductors, does not provide them as a standard twisted pair. Further, the HDMI cable of the present disclosure, while designed to operate and be terminated according to the HDMI standard, has a completely different internal design to what is traditionally referred to as HDMI cable.

Figure 2A:
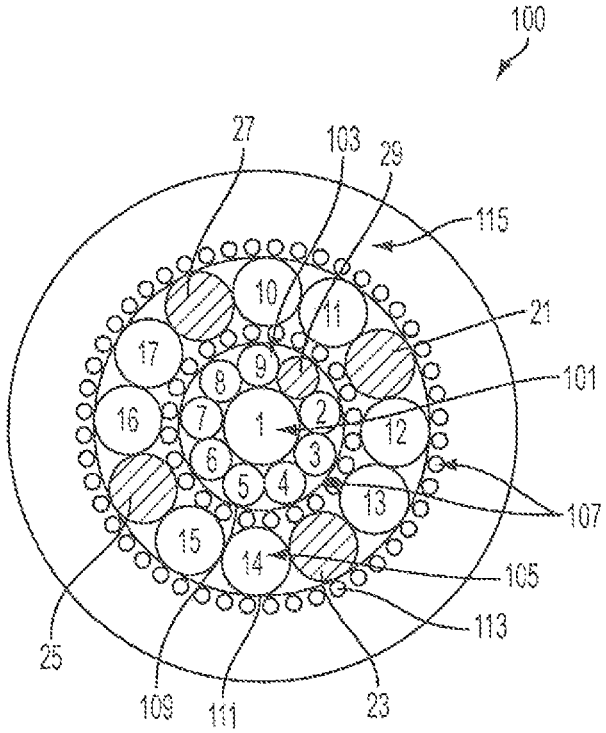
FIG. 2A Provides a stylized cut-through view of a first embodiment of a multimedia cable.

FIG. 2 shows a cross-sectional representative view of an embodiment of a cable (100) designed for HDMI protocol use. The cable comprises seventeen cable cores (1-17) each of which comprises a conductor with its own dedicated jacket, along with five component unjacketed conductors (21), (23), (25), (27), and (29). These will serve as the fourteen shielded conductors and five grounds of a standard HDMI cable (with three extra cores being available for later expansion or for use with additional transmission components). The cores (1-17) and conductors (21), (23), (25), (27), and (29) are not arranged into twisted pairs as the cable (100) comprises two concentric rings (103) and (105) of conductors about a central power cable (101).

In the embodiment of FIG. 2, conductor (101) which is the center of the cable (100), is generally used to provide for the power transport capability of the cable (100). There is then a first ring of conductors (103) arranged to surround the core (101). The first ring of conductors (103) comprises a plurality of generally parallel cores (2), (3), (4), (5), (6), (7), (8), and (9) along with generally a single ground (29). The ground (29) will serve as a drain for this inner ring (103) and for the power (101) and the remaining conductors will serve as the various miscellaneous protocol (CDC etc.) cores of the HDMI protocol. These components will generally be arranged side by side and may be parallel to cable (100) or may slowly twist around it in a generally uniform fashion.

As should be apparent, there are eight cores (plus the ground) shown in the inner ring (103) which is more than the five cores and ground used to carry the non-audio/video/clock signals in a current HDMI cable. The three extra conductors (e.g. (7), (8), and (9) although the choice of which core to terminate at which pin on the HDMI connector is left to the installer and any core (2-9) in the inner ring (103) may be assigned to any channel of the HDMI protocol) may be provided to make sure that a complete inner ring (103) is produced when using cores of a certain size. Specifically, these extra cores are provided so that there is a complete ring of material and the inner ring (103) does not include gaps or spaces but is generally consistent and solid. It also provides an inner ring (103) outer diameter of fixed size so that there is sufficient bulk upon which the outer ring (105) is placed. These extra cores, while they do not have a specific use under the current HDMI protocol, can be used for future protocol needs, can be used for proprietary transfers which are not part of the protocol, or may be put to other purposes as known to one of ordinary skill.

It should be recognized that in an alternative embodiment, the extra cores in the inner ring (103) may be eliminated as they are not strictly necessary for the cable (100) to operate as an HDMI cable. However, in such an embodiment, the components of the inner ring (103) (of which there may be five cores plus the drain) may be constructed of a larger gauge wire and/or have increased jacket thickness to provide for them to be larger. In this way, the inner ring (103) is again complete about the power core (101). Alternatively, fillers (such as plastic rods or similar materials) may be used in place of the extra cores to provide for completion of the ring (103). In a still further embodiment, the ring (103) may simply have gaps present and the Al-MYLAR (Aluminum and polyester film or plastic sheet) tape (109) and shield (107) may be used to generally smooth the outer surface of the ring (103) to provide for the surface on which the second ring (105) is placed. As should be apparent, the size consideration can be beneficial in making sure that both the inner ring (103) and outer ring (105) each include cores and grounds that are arranged in concentric rings, without having extra gaps, and making sure the rings (103) or (105) have sufficient circumference to accommodate all the cores and conductors included therein.

Outside of the first ring (103) of conductors there is a shield (107), which in the depicted embodiment is formed from spiral coiled conducting wires but may be of any design including, but not limited to, a wire braid or even a cast metal surface, which serves to isolate the signals carried by the inner ring (103) from those of the outer ring (105) and can also provide for cable strength. There is also provided a Al-MYLAR (Aluminum and polyester film or plastic sheet) tape (109) to separate the first ring of conductors (103) from the second ring (105). The Al-MYLAR (Aluminum and polyester film or plastic sheet) tape (109) and shield (107) may be eliminated in alternative embodiments as the shielding and segregation may be unnecessary depending on design of internal components and desired properties of the resultant cable (100).

The shield (107) will generally be surrounded by a second ring (105) of conductors. In this embodiment, there are eight cores (10-17) and four drain conductors provided in the second ring (105). These are generally used to correspond to the four twisted pair cables utilized in the standard HDMI cable arrangement but are not arranged with pairs twisted about each other. Instead, the members of each "pair" are arranged generally next to each other and each "pair" is separated by a ground.

Figure 2B:
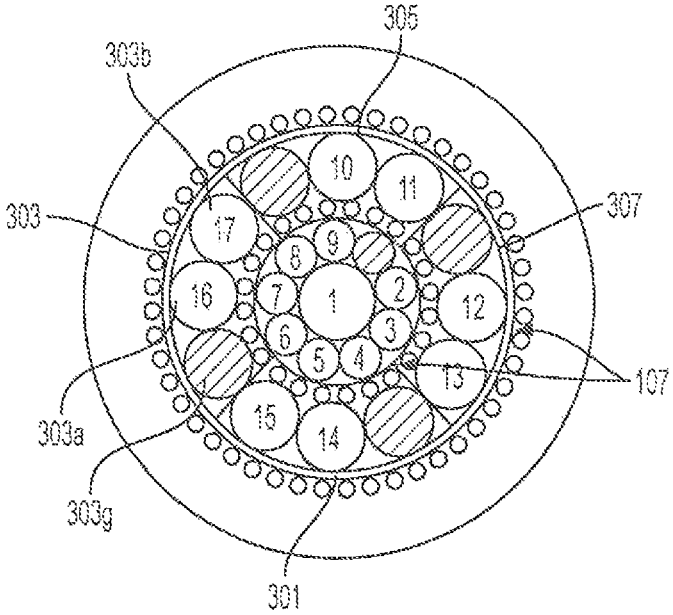
FIG. 2B Provides the embodiment of FIG. 2A with labeling to show exemplary "twisted pair" groups of FIG. 2A FIG. 3 Provides a stylized cut-through view of a second embodiment of a multimedia cable.

As can be seen in FIG. 2B, the cores will generally be utilized so that there are two data cores separated by a ground. Thus, the eight cores and four grounds are logically grouped into four "sets" (301), (303), (305) and (307) each of which includes two cores (e.g. (303*a*) and (303*b*)) and a ground (e.g. (303*g*)). These four sets (301), (303), (305) and (307) correspond to the four twisted pairs in a standard HDMI cable and therefore three of the groups (301), (303), and (305) provide the three twisted audio video pairs (and associated ground) and the fourth (307) providing the clock signal (and associated ground). As discussed above. Specific termination of the cores and drains is left to the manufacturer that attaches the HDMI connector to the cable (100) and thus the above reference to which of the groups (301), (303), (305), and (307) comprises which audio, visual, or clock signal is purely exemplary and different groups can have different function depending on the desire of the installer and/or manufacturer.

The second ring of conductors (105) again may comprise generally parallel conductors relative the power cable (100) or the second ring (105) components may twist about the power cable (100) in a generally helical fashion. The second ring (105) is again generally surrounded by a Al-MYLAR (Aluminum and polyester film or plastic sheet) tape (111) and a shield (113) which may be of similar structure to shield (107). There will then generally be an insulative jacket (115) placed thereon to protect the cable, provide for electrical isolation, and form its outer structure.

Figure 1:
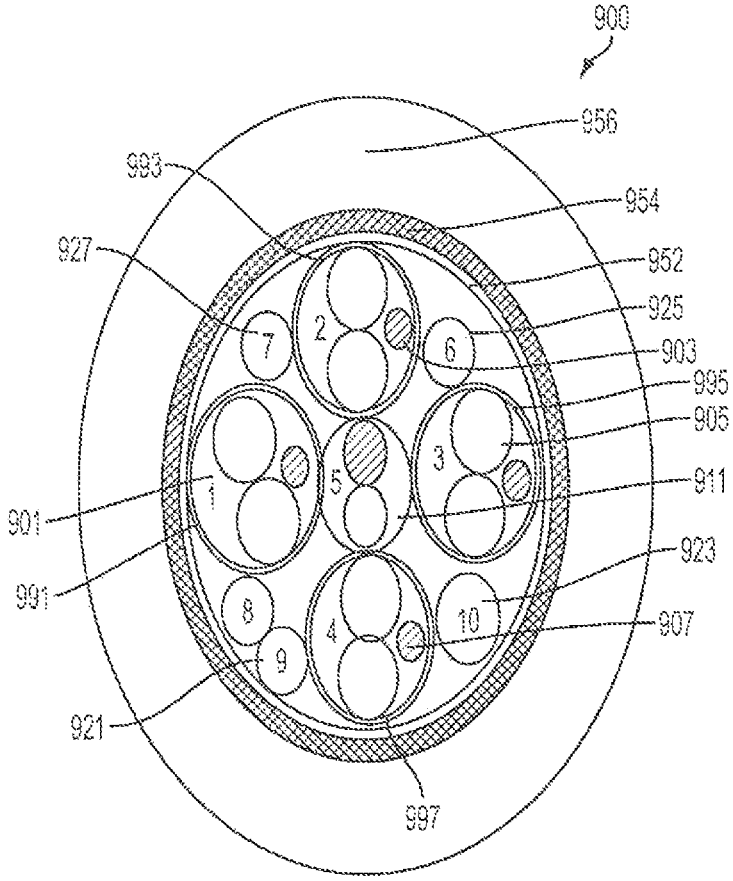
FIG. 1 PRIOR ART
FIG. 1 provides a stylized cut-through view of an embodiment of a prior art cable used with HDMI protocol.

As should be clear from the provided FIGS., the cable (100) does not include conductors or cores arranged as a twisted pair and provided with an independent jacket internal to the outer jacket (115) as has traditionally been the design of HDMI cable as shown in FIG. 1. Instead, the four twisted pairs are replaced by four groups of two generally parallel conductors in the outer ring which groups are separated by a ground.

The use of the two rings of conductors (103) and (105) instead of twisted pairs provides for a number of benefits over traditional HDMI cable construction. In particular, the arrangement can provide for sufficient elimination of crosstalk and other interference to allow the cable (100) to function as an acceptable HDMI cable. That is, meet the requirements of the HDMI standard. Secondly, the cable (100) generally allows for a much smaller design. In the first instance, the cores (1-17) can be of smaller diameter than has traditionally be used in an HDMI cable, which allows for the cable (100) to be smaller than traditionally constructed designs. Further, as the twisted pairs are eliminated and an effectively co-axial arrangement is used, internal jackets are eliminated and the resultant cable (100) is smaller since there is no need for the jacket material to be included. Lost space from the twisting action is also not present.

Figure 3:
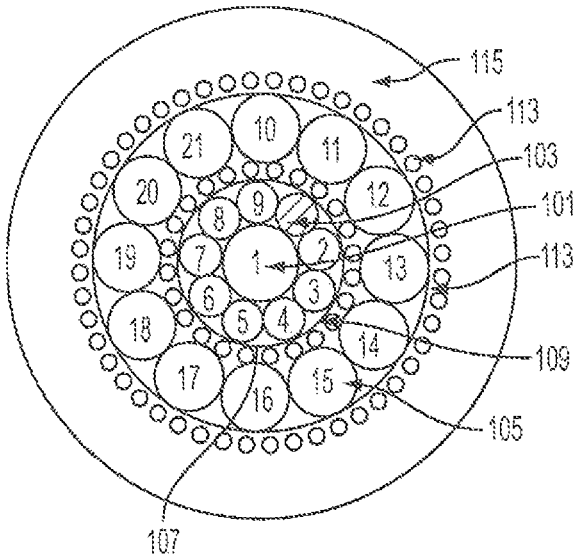
Figure 4:
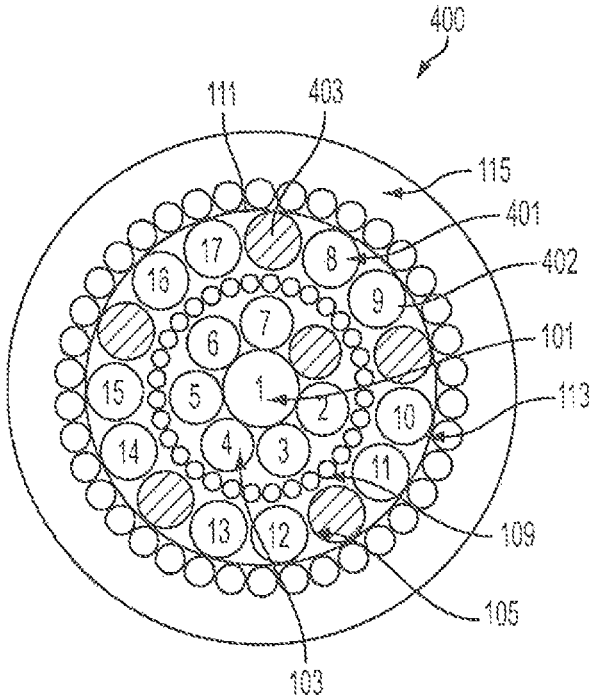
FIG. 4 Provides a stylized cut-through view of a third embodiment of a multimedia cable.

FIGS. 3 and 4 provide for alternative designs of a multimedia cable which utilize the same generally two-ring construction of the above discussed embodiment but utilize slightly altered internal arrangements and components. These designs are all exemplary, and others would be apparent to those of ordinary skill.

FIG. 3 provides for a design having the same number of components in each ring as the embodiment of FIG. 2. However, in this embodiment, there are no specific grounds (drain) conductors but the entire inner (103) and outer ring (105) is formed from jacketed conductors or cores (1-21). This can provide for increased capacity and can allow for elimination of some of the shielding (specifically the Al-MYLAR (Aluminum and polyester film or plastic sheet) tape) as each core forming the cable includes an individual jacket. However, the design can permit increased crosstalk and is generally not as preferred as the embodiment of FIG. 2.

FIG. 4 provides for a design of particular use for HDMI version 1.4 capability. In HDMI version 1.4 there is additional functionality added to the cable (400). This includes Ethernet and audio return capability (HEAC). In order to accommodate the additional functionality, the cable (400) includes an additional two cores (401) and (402) plus a ground (403) in the outer ring (105) which acts as an additional twisted pair and associated ground to carry the additional signals. As part of this arrangement two of the "extra cores" of FIG. 2 have been removed with the inner ring (103) making that ring smaller. This can allow for accommodation of the larger outer ring (105) without substantive increase in the total cable (400) diameter and can provide that the decreased inner ring (103) size allows for accommodation of the increased outer ring (105) size without have to make non-concentric rings.

As should be clear from FIG. 2B, it is generally preferred that each "pair" of cores (301), (303), (305), (307) which is supplying data be separated from the adjoining pairs by a ground and this is also true of the design of FIG. 4. One of the two adjoining grounds is used as the ground for that pair while the other is used as the ground for the next adjacent pair.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A multimedia cable comprising:

a central cable core;

a first ring formed of a first plurality of cable cores arranged concentrically about said central cable core; and a second ring formed of a second plurality of cable cores arranged about said first concentric ring of cable cores;

wherein said central cable core, said first plurality of cable cores, and said second plurality of cable cores comprise a total of at least nineteen cable cores, including at least fourteen individually shielded cable cores and at least five unshielded cable cores;

wherein said first plurality of cable cores are arranged generally parallel to each other and include a single unshielded cable core; and wherein said second plurality of cable cores are arranged generally parallel to each other and include four unshielded cable cores.

2. The multimedia cable of claim 1 wherein said cable is suitable for carrying signals in accordance with the HDMI standard version 1.3.

3. The multimedia cable of claim 1 wherein said cable is suitable for carrying signals in accordance with the HDMI standard version 1.4.

4. The multimedia cable of claim 1 wherein said at least nineteen cable cores comprises exactly nineteen cable cores.

5. The multimedia cable of claim 1 wherein said at least nineteen cable cores comprises at least twenty-two cable cores.

6. The multimedia cable of claim 5 wherein said at least twenty-two cable cores comprises at least seventeen individually shielded cable cores and at least five unshielded cable cores.

7. The multimedia cable of claim 6 wherein said at least twenty-two cable cores comprises exactly seventeen individually shielded cable cores and exactly five unshielded cable cores.

8. A multimedia cable comprising:

a central cable core;

a first ring formed of a first plurality of cable cores arranged concentrically about said central cable core; and a second ring formed of a second plurality of cable cores arranged about said first concentric ring of cable cores;

wherein said central cable core, said first plurality of cable cores, and said second plurality of cable cores comprise a total of exactly seventeen individually shielded cable cores and exactly five unshielded cable cores, with eight of said individually shielded cable cores and one of said unshielded cable cores forming said first plurality of cable cores, and eight of said individually shielded cable cores and four of said unshielded cable cores forming said second plurality of cable cores;

wherein said first plurality of cable cores are arranged generally parallel to each other; and wherein said second plurality of cable cores are arranged generally parallel to each other.

9. The multimedia cable of claim 8 wherein said second plurality forms a repeating pattern of sets, each set formed from an unshielded cable core and two individually shielded cable cores.

10. The multimedia cable of claim 5 wherein said first plurality comprises at least eight cable cores and said second plurality comprises at least fifteen cable cores.

11. The multimedia cable of claim 5 wherein said first plurality comprises at least seven individually shielded cable cores and said second plurality comprises at least ten individually shielded cable cores.

12. The multimedia cable of claim 1 further comprising a shield arranged between said first ring and said second ring.

13. The multimedia cable of claim 12 further comprising an Aluminum-MYLAR (polyester film) tape arranged between said first ring and said second ring.

14. The multimedia cable of claim 13 further comprising a shield surrounding said second ring.

15. The multimedia cable of claim 14 further comprising an Aluminum-MYLAR (polyester film) tape surrounding said second ring.

16. The multimedia cable of claim 14 comprising an insulative jacket surrounding said shield that is surrounding said second ring.

17. A multimedia cable comprising:

a central cable core;

a first concentric ring formed from eight individually shielded cable cores and one unshielded cable core arranged about said central cable core; and a first shield surrounding said first concentric ring;

a second concentric ring formed from eight individually shielded cable cores and four unshielded cable cores arranged about said first concentric ring;

a second shield surrounding said second concentric ring; and an insulative jacket surrounding said second shield;

wherein said cable cores forming said first concentric ring are arranged generally parallel to each other; and wherein said cable cores forming said second concentric ring are arranged generally parallel to each other.

* * * * *